US008601947B2

(12) United States Patent
Kaiser et al.

(10) Patent No.: US 8,601,947 B2
(45) Date of Patent: Dec. 10, 2013

(54) OPTIMIZED-INTENSITY CONTROL MARK MEASUREMENT AND APPARATUS FOR PERFORMING THE MEASUREMENT

(75) Inventors: Michael Kaiser, Heidelberg (DE); Frank Schumann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 715 days.

(21) Appl. No.: 12/555,050

(22) Filed: Sep. 8, 2009

(65) Prior Publication Data

US 2010/0058944 A1 Mar. 11, 2010

(30) Foreign Application Priority Data

Sep. 8, 2008 (DE) ..... 10 2008 046 216

(51) Int. Cl.
*B41F 33/00* (2006.01)
*B41F 33/14* (2006.01)

(52) U.S. Cl.
USPC ..... 101/484; 101/481

(58) Field of Classification Search
USPC ..... 101/DIG. 45, DIG. 36, 486, 481, 485, 101/484; 356/425, 402
See application file for complete search history.

(56) References Cited

U.S. PATENT DOCUMENTS

| | | | | |
|---|---|---|---|---|
| 4,142,105 | A * | 2/1979 | Erdmann | 250/548 |
| 4,366,753 | A * | 1/1983 | Glanz et al. | 101/181 |
| 4,528,630 | A * | 7/1985 | Sargent | 700/125 |
| 4,561,103 | A | 12/1985 | Horiguchi et al. | |
| 5,247,462 | A * | 9/1993 | Blasius et al. | 700/125 |
| 5,249,139 | A * | 9/1993 | Blasius et al. | 382/112 |
| 5,813,333 | A * | 9/1998 | Ohno | 101/181 |
| 6,622,621 | B2 * | 9/2003 | Bucher et al. | 101/228 |
| 6,782,814 | B2 * | 8/2004 | Tokiwa | 101/211 |
| 7,334,520 | B2 * | 2/2008 | Geissler et al. | 101/232 |
| 7,398,733 | B2 | 7/2008 | De Vries et al. | |
| 7,637,210 | B2 * | 12/2009 | Geissler et al. | 101/481 |
| 2005/0249380 | A1 * | 11/2005 | Geissler et al. | 382/112 |
| 2010/0007690 | A1 | 1/2010 | Geissler et al. | |

FOREIGN PATENT DOCUMENTS

| | | | |
|---|---|---|---|
| CN | 1693075 | A | 11/2005 |
| CN | 1950209 | A | 4/2007 |
| DE | 32 48 928 | C2 | 9/1987 |
| DE | 42 18 762 | A1 | 12/1993 |
| DE | 100 16 566 | A1 | 10/2001 |
| DE | 10 2004 021 601 | A1 | 12/2005 |
| DE | 10 2004 061 951 | A1 | 7/2006 |

OTHER PUBLICATIONS

German Patent and Trademark Office search report, dated Jun. 3, 2009.

* cited by examiner

*Primary Examiner* — Daniel J Colilla
*Assistant Examiner* — Leo T Hinze
(74) *Attorney, Agent, or Firm* — Laurence A. Greenberg; Werner H. Stemer; Ralph E. Locher

(57) ABSTRACT

An apparatus and a method for evaluating control marks on printing materials by an optical sensor connected to a computer, which interprets overshooting of a predefined intensity threshold as it registers the printing material being a line of a printed control mark. The apparatus is distinguished by the fact that the control mark is registered by a color measuring instrument and that the intensity threshold of the optical sensor is calculated by the computer in dependence on the measured color value registered by the color measuring instrument.

13 Claims, 3 Drawing Sheets

OPTIMIZED-INTENSITY CONTROL MARK MEASUREMENT AND APPARATUS FOR PERFORMING THE MEASUREMENT

CROSS-REFERENCE TO RELATED APPLICATION

This application claims the priority, under 35 U.S.C. §119, of German application DE 10 2008 046 216.0, filed Sep. 8, 2008; the prior application is herewith incorporated by reference in its entirety.

BACKGROUND OF THE INVENTION

Field of the Invention

The present invention relates to an apparatus and a method for evaluating control marks on printing materials by an optical sensor connected to a computer, which interprets overshooting of a predefined intensity threshold as it registers the printing material as a line of a printed control mark.

In offset presses, accurate-register and accurate-position printing is important, since otherwise faults can be seen in the image. Here, accurate-register printing is understood to mean the exact overprinting of a plurality of color separations on one side of a printing material. Accurate-position printing usually relates to what is known as reverse positioning, which means that, in the case of recto and verso printing on both sides, the color separations on the front side are arranged at the same distance from the edges of the printing material as those on the rear side. The control marks used for this purpose normally have a plurality of differently arranged and differently thick lines, which are printed in the different colors of the color separations. By printing the register or position lines beside one another and over one another, the register mark or positioning mark is then produced, which is registered and evaluated by an appropriate optical sensor. The lines of the control marks must not exceed a predefined spacing tolerance, otherwise visible image defects are to be expected in the printed image and the printing quality is poor.

Published, non-prosecuted German patent application DE 42 18 762 A1 discloses a scanning arrangement for register marks produced by multicolor printing. The scanning arrangement is configured to register fast-moving register marks in the press. In the scanning arrangement, the gain of a photoreceiver is matched to the contrast relationships of the register mark to be expected in each case. This is done because register marks of different printing inks supply a different intensity signal, for example black printing ink supplies high signal amplitudes while blue printing ink supplies only weak signals. For this purpose, the gain factor is matched to the color of the register marks to be expected, so that the signals to be evaluated have an approximately equal amplitude. However, this procedure functions only if a standard order of colors to be expected is maintained. In the case of unexpected colors or a changed order of colors, on the other hand, the scanning arrangement functions only poorly, since the colors are then allocated erroneous gain factors on the basis of the unexpected order of colors or an unexpected color.

SUMMARY OF THE INVENTION

It is accordingly an object of the invention to provide an optimized-intensity control mark measurement, which overcome the above-mentioned disadvantages of the prior art methods and devices of this general type, which function even in the event of unexpected colors in register marks and in the event of a changed order of colors.

With the foregoing and other objects in view there is provided, in accordance with the invention, a method for evaluating control marks on printing materials. The method includes interpreting, via an optical sensor connected to a computer, overshooting of a predefined intensity threshold as the computer registers a printing material being a line of a printed control mark; registering the printed control mark via a color measuring instrument; and calculating an intensity threshold of the optical sensor via the computer in dependence on a measured color value registered by the color measuring instrument.

The present invention is suitable in particular for use for register control in sheetfed offset presses and web fed offset presses. With the present invention, account is taken of the fact that too low an intensity threshold leads to the measured result becoming inaccurate on account of the excessively low signal-to-noise ratio while, in the case of an excessively high intensity threshold, no lines are registered on the control marks. In order to avoid these problems, the control mark is registered by a color measuring instrument, in order in this way to be able to evaluate the color of the control mark exactly. Depending on the color of the control mark registered by the color measuring instrument, the intensity threshold of the optical sensor for registering the control mark is then adjusted, so that the measured result is as accurate as possible and, nevertheless, the lines on the control mark are registered reliably. To this end, the measured color values from the color measuring instrument are transmitted to a computer, which evaluates the measured color values and calculates the suitable intensity threshold of the optical sensor. During this procedure, the order of colors and the color of the respective control mark then no longer play any part since, in the case of each control mark, first the color is registered by the color measuring instrument and then, depending on the color registered, the suitable intensity threshold for the optical sensor is determined automatically.

In one embodiment of the invention, provision is made for the control mark to be illuminated during its registration and for the intensity threshold to be determined by the computer while taking the spectrum of the illumination into account. For the purpose of correct color registration, the color measuring instrument needs predefined, if possible constant, illumination. For this reason, the color measuring instrument normally has a source of illumination whose spectrum is known and which illuminates the printing material. This spectrum of the source of illumination is then likewise taken into account together with the color spectrum of the control mark registered, in order to calculate the suitable intensity threshold.

In a further refinement of the invention, provision is additionally made for the intensity threshold to be determined by the computer while taking the spectrum of the optical sensor into account. As a result of taking the spectrum of the optical sensor into account, the measurement accuracy is increased further. Particular advantages result if both the spectrum of the illumination and the spectrum of the optical sensor are taken into account in the calculation of the intensity threshold, since then all the influencing variables are taken into account. Since the spectrum of the source of illumination and the spectrum of the optical sensor for registering the control mark normally do not change during operation, these spectra can be stored directly in the computer. Together with the measured spectral values from the color measuring instrument, the computer can thus simply calculate the resultant spectrum which is used to define the intensity threshold. The calculation of the resultant spectrum is done mathematically by means of convolution of the spectra of the source of illumination, of the optical sensor and of the measured color values registered by the color measuring instrument. The computer then determines the intensity threshold for the optical sensor from the amplitude of the resultant spectrum, so that an analog-digital converter contained in the optical sensor is driven appropriately.

Provision is advantageously made for the registration of the printing material to be carried out in a press and for the printing material to be held on a cylinder by sheet grippers during the registration. During this procedure, the printing materials are measured directly in the press in a sheetfed rotary press, in that the printing materials transported through under the optical sensor together with the printed control marks are registered while still in the machine. During the registration by the optical sensor and the color measuring instrument, in this case the printing materials are, for example, held on the impression cylinder of the last printing unit by the sheet grippers present there and are thus stabilized during the measuring operation. In this way, both register marks and positioning marks are registered as control marks on each individual printing material directly in the press and used for the appropriate control. In this case, the color measuring instrument, which has a spectral measuring head in order to determine the measured spectral color values, is preferably also integrated in the press in the last printing unit.

If both the color measuring instrument and the optical sensor are arranged at the same point in the press, the optical sensor and the color measuring instrument can form one structural unit. This has the great advantage that there has to be only one mounting holder for both devices and, in addition, optical sensor and color measuring instrument can be removed together. Furthermore, only one set of cabling has to be laid at one location in the press, since both the optical sensor and the color measuring instrument are integrated in the press at the same location because of the structural unit. This location is preferably immediately at the output from the press nip in the last printing unit, where all the register marks are present on the printing material.

Other features which are considered as characteristic for the invention are set forth in the appended claims.

Although the invention is illustrated and described herein as embodied in an optimized-intensity control mark measurement, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
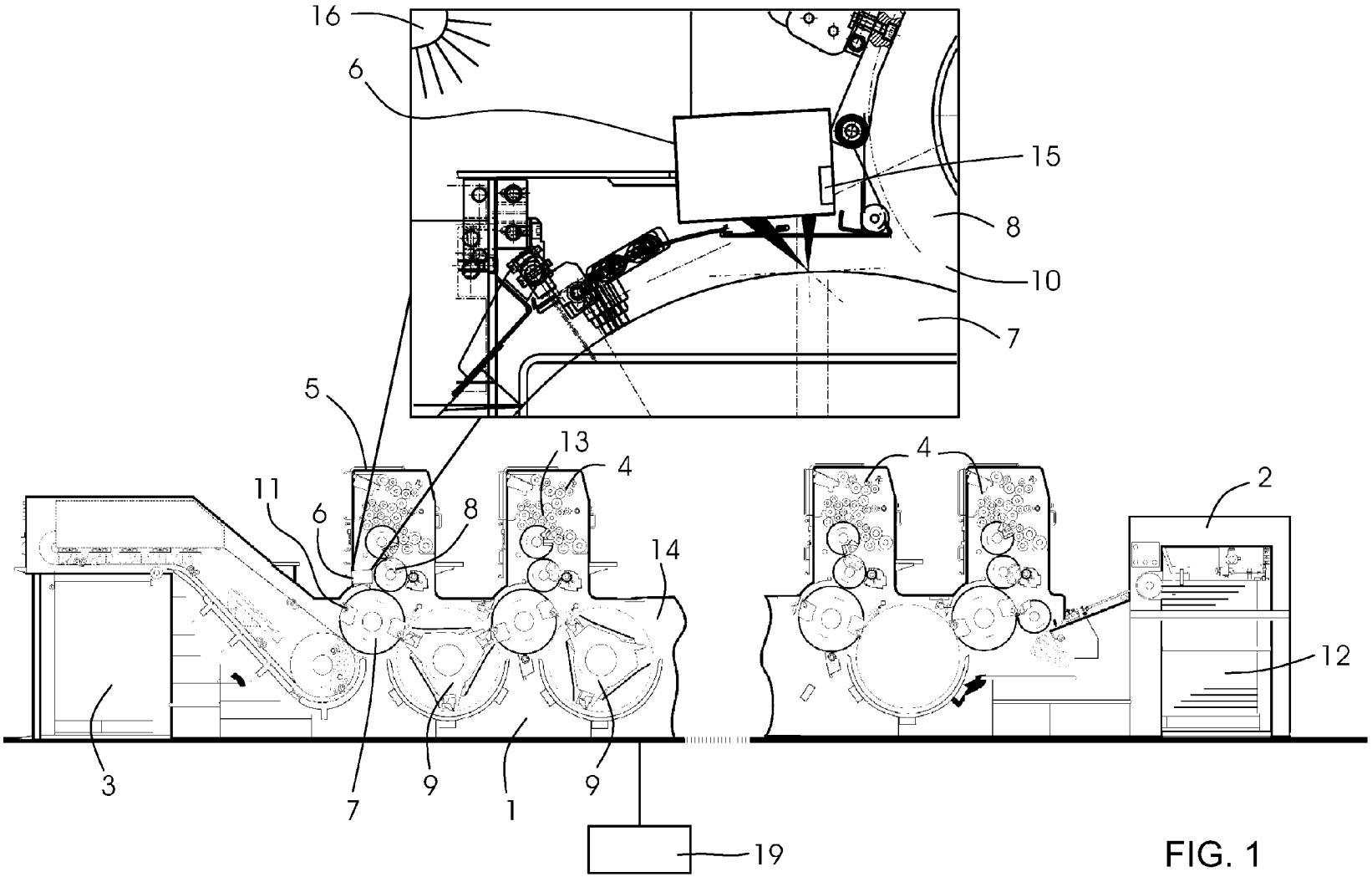
FIG. 1 is a diagrammatic, side view of a sheetfed offset press having a plurality of printing units and an integrated optical sensor with a color measuring instrument in a last printing unit.

Referring now to the figures of the drawing in detail and first, particularly, to FIG. 1 thereof, there is shown by way of example, a sheetfed press 1 that has four printing units 4, 5, it being indicated in the middle that the press 1 can have still further printing units 4. Arranged in the last printing unit 5 of the press 1 is an in-line color measuring instrument 6, which measures the color of the finally printed sheets 12 at the outlet from a press nip 10 in the last printing unit 5. In addition, the in-line color measuring instrument 6 has a register sensor 15, which measures control marks in order to determine the positioning accuracy and register accuracy on the printing materials 12. The color measuring instrument 6 in the form of a measuring beam with the register sensor 15 incorporated forms one structural unit and, mounted jointly on a rail, can be removed laterally from the last printing unit 5 and thus maintained better. In order to have defined illumination conditions during the color measuring operation and during the registration of control marks 17, 18 on the printing material 12, in the immediate vicinity of the in-line color measuring instrument 6 there is a source of illumination 16, which illuminates the sheet 12 with a predefined spectrum. This illumination spectrum B is stored in a control computer 19, which is connected to the in-line color measuring instrument 6 and the register sensor 15 and can thus be used to determine the intensity threshold of the register sensor 15.

The press 1 has a feeder 2, in which sheet printing materials 12 are separated and fed to a first printing unit 4. The printing units 4, 5 each have impression cylinders 7, blanket cylinders 8 and plate cylinders 13, the latter carrying the printed image. Between the printing units 4, 5, the sheets 12 are transported by transport cylinders 9, the transport cylinders 9 being assisted by a blown air guide 14, so that the transported sheets 12 have no contact with other parts. The air metering of the blown air guide 14 is also carried out via the control computer 19. When the sheets 12 leave the press nip 10 between the blanket cylinder 8 and the impression cylinder 7 in the last printing unit 5, their color is measured by the in-line color measuring instrument 6, in order to calculate in the control computer 19 the corresponding intensity threshold in each case for the subsequent register and position measurement for the control mark 17, 18 to be measured. This is done so quickly in the control computer 19 that the register sensor 15 arranged immediately after the color measuring instrument 6 is driven appropriately correctly with the suitable intensity threshold S, so that it is able to register correctly the lines of the respective mark, matched to the color of the respective control mark 17, 18 on the printing material 12 determined by the color measuring instrument 6. In order that the sheet 12 is stable during the measuring operations, it is held on one side in the press nip 10 and on the other side by the sheet grippers 11 of the impression cylinder 7. However, the color measuring instrument 6 of the press 1 can in this case not only be used to determine the suitable intensity threshold S as a function of the control marks 17, 18 to be measured but, of course, can also be used, in parallel with the registration of measured color values on the sheet 12, to monitor the correct coloration in the printed image in relation to the printed original. This color monitoring is normally the main task for color measuring instruments 6 in presses 1.

Figure 2:
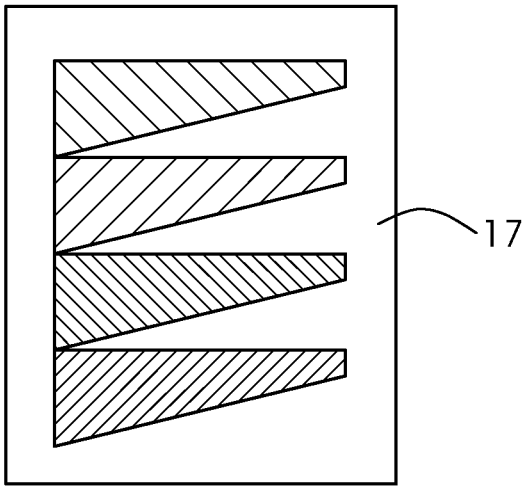
FIG. 2 is an illustration of a fine register mark.
Figure 3:
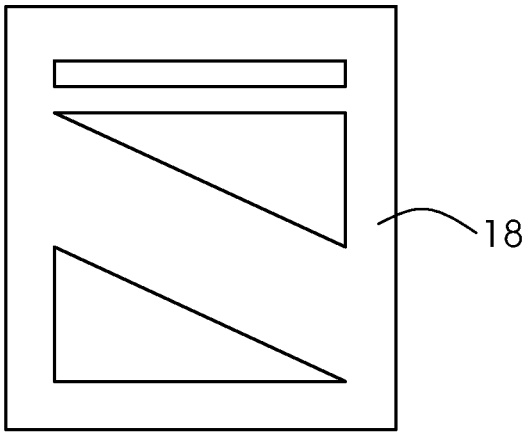
FIG. 3 is an illustration of a coarse register mark.

In FIG. 2, a fine register mark 17 is depicted by way of example, while FIG. 3 shows a coarse register mark 18. The register marks 17, 18 are printed beside one another or above one another in all the colors of the respective print job, appropriate lines being present, from whose spacings the register and positioning accuracy can be determined by the control computer 19. To this end, the lines of the control marks 17, 18 must be determined exactly and reliably by the register sensor 15. For this reason, in the case of the present invention, first the color of the respective control mark 17, 18 is registered by the color measuring instrument 6, and then the intensity threshold S of the ND converter in the register sensor 15 is adapted in the computer 19 in accordance with the measured color values registered.

For the purpose of optimal determination of the intensity threshold S, not only is the spectrum of the color F measured by the color measuring instrument 6 taken into account in the control computer 19 but also the known spectrum B of the source of illumination 16 and the likewise known spectrum E of the register sensor. In this case, the two spectra B and E are stored in the control computer 19 and thus do not need to be determined during the measuring operation. In this case, the color spectrum F is determined anew by use of a spectral measurement by the color measuring instrument 6 for each control mark 17, 18. From the three spectra B, E, F, the control computer 19 determines a resultant spectrum R by means of the mathematical operation of convolution. The amplitude of the resultant spectrum R is then taken by the control computer 19 as a measure of the intensity threshold S of the register sensor 15 that is to be set. The greater the amplitude of the resultant spectrum R, the higher the intensity threshold S of the register 15 can be set, the converse also being true.

Figure 4:
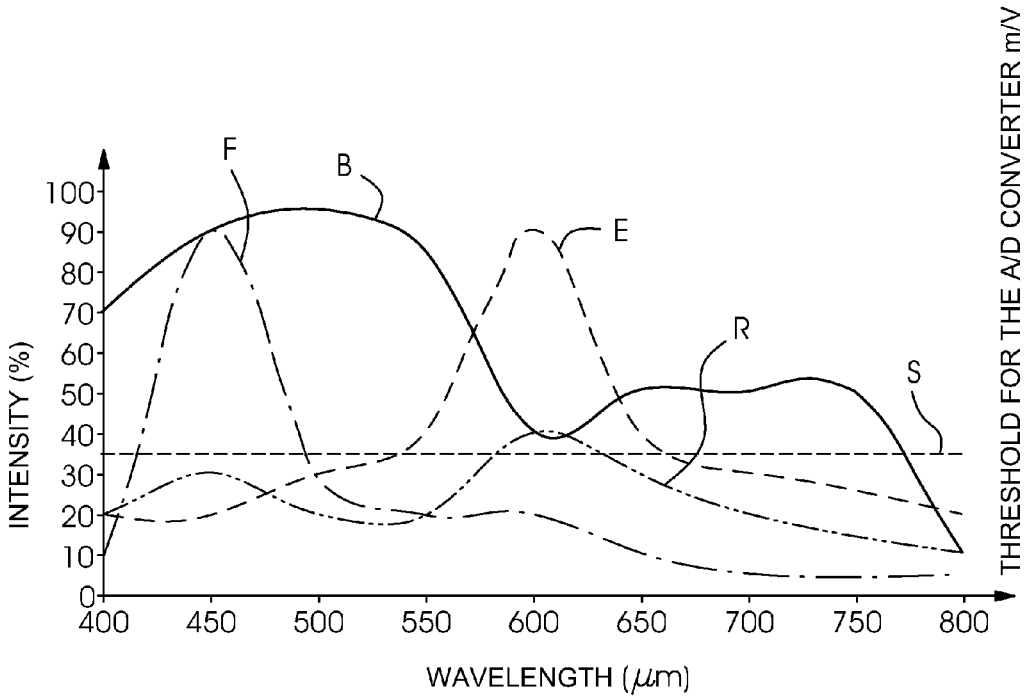
FIG. 4 is a graph showing the spectra of a first color to be taken into account when determining the intensity threshold.
Figure 5:
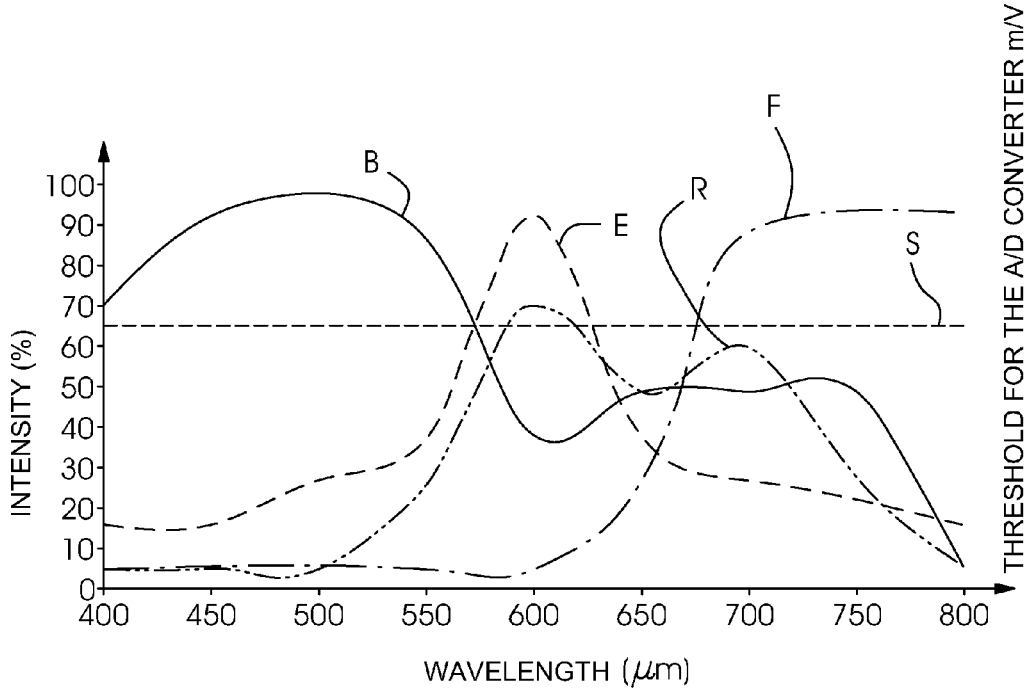
FIG. 5 is a graph showing the spectra of a second printing ink to be taken into account when determining the intensity threshold.

In FIGS. 4, 5, two printing inks are depicted by way of example for this purpose. The printing ink in FIG. 4 is a very bright printing ink, so that the intensity threshold S must be set appropriately low. In FIG. 5, on the other hand, a dark color like black is depicted, in which the intensity threshold S of the analog-digital converter in the register sensor 15 can be set correspondingly high. A high intensity threshold ensures a high measurement accuracy, for which reason the intensity threshold S is always set as high as possible. In the case of bright colors, in particular special colors, the intensity threshold must be reduced, however, since otherwise no lines can be registered by the register sensor 15 any more and there is no measured result. By use of the present invention, it is thus possible to register bright special colors by the register sensor 15 as well and, nevertheless, when possible, to set the intensity threshold S of the register sensor 15 as high as possible, in order to increase the measurement accuracy.

The invention claimed is:

1. A method for evaluating control marks on printing materials, which comprises the steps of:

interpreting, via an optical sensor connected to a computer, overshooting of a predefined intensity threshold as the computer registers a printing material being a line of a printed control mark;

registering the line of the printed control mark via a color measuring instrument;

calculating an intensity threshold of the optical sensor via the computer in dependence on a measured color value registered by the color measuring instrument; and calculating the intensity threshold via the computer by a mathematical operation of convolution of a spectrum of a registered printing ink.

2. The method according to claim 1, which further comprises carrying out the registration of the printing material in a press and the printing material is held on a cylinder by sheet grippers during the registration.

3. The method according to claim 1, wherein the printed control mark is one of a register mark and a positioning mark.

4. A method for evaluating control marks on printing materials, which comprises the steps of:

interpreting, via an optical sensor connected to a computer, overshooting of a predefined intensity threshold as the computer registers a printing material being a line of a printed control mark;

registering the line of the printed control mark via a color measuring instrument;

calculating an intensity threshold of the optical sensor via the computer in dependence on a measured color value registered by the color measuring instrument; and illuminating the printed control mark during its registration, and determining the intensity threshold by means of the computer by a mathematical operation of convolution of a spectrum of an illumination.

5. The method according to claim 4, which further comprises determining the intensity threshold by means of the computer by a mathematical operation of convolution of a spectrum of the optical sensor.

6. The method according to claim 5, which further comprises storing at least one of the spectrum of the illumination and the spectrum of the optical sensor in the computer.

7. An apparatus for evaluating control marks on printing materials, the apparatus comprising:

a computer;

an optical sensor connected to said computer for interpreting overshooting of a predefined intensity threshold during registration of a printing material as a line of a printed control mark;

a color measuring instrument; and the apparatus being set up such that the line of the printed control mark is registered by means of said color measuring instrument, and in that the predefined intensity threshold of said optical sensor is calculated by said computer in dependence on a measured color value registered by said color measuring instrument;

said computer for calculating the intensity threshold by a mathematical operation of convolution of a spectrum of a registered printing ink.

8. The apparatus according to claim 7, wherein said color measuring instrument has a spectral measuring head.

9. The apparatus according to claim 7, further comprising a source of illumination for illuminating the printed control mark during its registration.

10. The apparatus according to claim 7, wherein said color measuring instrument and said optical sensor are disposed in a press.

11. The apparatus according to claim 10, wherein said optical sensor and said color measuring instrument form one structural unit.

12. The apparatus according to claim 10, wherein said optical sensor and said color measuring instrument are disposed in a last printing unit of the press.

13. A press, comprising:

a printing unit; and an apparatus for evaluating control marks on printing materials, said apparatus including:

a computer;

an optical sensor connected to said computer for interpreting overshooting of a predefined intensity threshold during registration of a printing material being a line of a printed control mark;

a color measuring instrument; and said apparatus being set up such that the line of the printed control mark is registered by means of said color measuring instrument, and in that the predefined intensity threshold of said optical sensor is calculated by said computer in dependence on a measured color value registered by said color measuring instrument;

said computer for calculating the intensity threshold by a mathematical operation of convolution of a spectrum of a registered printing ink.

* * * * *